United States Patent [19]

Furman

[11] Patent Number: 4,632,495

[45] Date of Patent: Dec. 30, 1986

[54] RIGHT-ANGLE MODULAR CONNECTOR WITH TWO-PART HOUSING

[75] Inventor: Lev B. Furman, York, Pa.

[73] Assignee: AMP Incorporated, Harrisburg, Pa.

[21] Appl. No.: 729,102

[22] Filed: Apr. 30, 1985

[51] Int. Cl.[4] ..... H01R 13/512

[52] U.S. Cl. ..... 339/210 M; 339/17 LC

[58] Field of Search ..... 339/206 R, 206 P, 210 R, 339/210 M, 219 R, 136 R, 136 M, 138, 141, 105, 107, 17 LC

[56] References Cited

U.S. PATENT DOCUMENTS

| | | | |
|---|---|---|---|
| 3,440,596 | 4/1969 | Frompovicz | 339/206 R |
| 3,503,035 | 3/1970 | Lazar et al. | 339/219 R |
| 3,707,696 | 12/1972 | Carter | 339/206 R |
| 3,864,010 | 2/1975 | Wasserlein, Jr. | 339/210 M |
| 4,010,999 | 3/1977 | Hoffman | 339/210 M |
| 4,033,658 | 7/1977 | Asick | 339/210 m |
| 4,050,769 | 9/1977 | Ammon | 339/210 M |
| 4,108,527 | 8/1978 | Douty et al. | 339/107 |

OTHER PUBLICATIONS

IBM Technical Disclosure Bulletin, vol. 21, No. 10, 3/1979, "Circuit Cord Connector Mounting Apparatus", Roy et al.

*Primary Examiner*—John McQuade

[57] ABSTRACT

A simplified structure for a right-angle modular connector includes a self-aligning arrangement for the connector cover and an L-shaped receiving portion thereof. Appropriately positioned flanges and a tongue and groove arrangement are provided and an abutting relationship prevents longitudinal movement between the two components of the housing. An L-shaped module is locked in position by a segmented rib structure cooperating with a plurality of channels on internal surfaces of the housing. The channels engage the rib segments and lock the module from movement relative to the housing.

6 Claims, 7 Drawing Figures

68
66
70
21
60

58
50
20
50a
50b
50c
60
72
64
62

RIGHT-ANGLE MODULAR CONNECTOR WITH TWO-PART HOUSING

TECHNICAL FIELD

This invention relates to electrical wiring connectors, and more specifically to right-angle connectors having an outer shell housing an internal module in which the various wires to be connected are accommodated in longitudinal passageways through the module.

BACKGROUND ART

Wiring connectors of various types are well known in the art. However, such connectors typically are difficult to manufacture, difficult to assemble, and difficult to service, thereby increasing the ultimate cost of use of such connectors.

In one known connector there is provided a one-piece shell and a module is inserted into the shell by longitudinal movement therein. A rib arrangement is provided on the horizontal surfaces of the module, and cooperating keyways are formed on the internal horizontal surfaces of the shell in order to prevent lateral movement of the module within the shell.

However, such a structure cannot be easily converted to an L-shaped, or right-angle connector. Additionally, a separate structure is required for preventing longitudinal movement of the module within the shell. Specifically, a spring structure is required to be attached to the inner surface of the shell and to engage the rear portion of the module ribs in order to prevent rearward movement of the module. In order to withdraw the module for servicing, a specialized tool needs to be applied in order to compress the springs to permit the module to be moved.

There is thus a need in the prior art for simply fabricated L-shaped connector, which is easily assembled, and which requires no further components or tools.

DISCLOSURE OF INVENTION

It is accordingly an object of the present invention to overcome the difficulties of the prior art and to provide a simply fabricated right-angle connector.

It is a more specific object of the invention to provide a simply fabricated right-angle connector which does not require attachment of separate components thereto in order to lock a module therein.

Yet another object of the invention is the provision of a simply manufactured and easily assembled right-angle connector in which longitudinal, lateral and transverse movement of an internal module is prevented by structural design of the housing and module components.

Yet a further object of the invention is the provision of a right-angle connector having a two-part housing which may be readily separated for servicing the module enclosed therein.

It is another object of the invention to provide a right-angle connector having internal structural design for locking an internal module from movement therein and for precisely aligning the module, and further including an arrangement for precisely locking contact pins in a longitudinal direction within the module.

It is still a further object of the invention to provide a right-angle connector including internal structural features for locking a module therein, the module including components for locking contact pins therein, and including still additional structural features for locking a wiring arrangement and for providing a strain relief therefor.

In accordance with these and other objects of the invention, there is provided a right-angle connector including a housing formed of an L-shaped receiving portion and a cover portion. An insulator module, having L-shaped passageways therein, is included within the housing formed by the receiving and cover portions. Additionally, there is provided a locking structure for locking the module longitudinally and laterally within the housing. Particularly, the locking structure includes a ribbed structure projecting from the module together with a plurality of channels on internal surfaces of the housing for engaging the ribbed structures.

Preferably, the ribbed structure provides a segmented rib and the channels include a plurality of channel segments for interlocking with the rib segments thus to prevent movement of the module within the housing. The rib segments may be provided on any of the surfaces of the module and the channels may further include a number of L-shaped channels.

The cover may include a self-aligning structure for alignment with the receiving portion. The self-aligning structure may include flanges descending from sidewalls thereof and laterally positioned for engaging inner surfaces of upstanding sidewalls of the receiving portion of the housing, thus to provide lateral locking of the cover with respect to the receiving portion. A tongue and groove structure may be provided between the cover and receiving portions of the housing to prevent relative movement therebetween.

Although the L-shaped structure provides longitudinal alignment of the wiring contacts within the module, additional aligning structure may be provided in the form of a number of retention pins. The module may include a plurality of holes for receiving the pins, and the contacts preferably have portions shaped to receive the retention pins. Thus, when a contact is longitudinally aligned, the retention pin is received therein and prevents further longitudinal movement. Preferably, the portions of the contacts are shaped to receive half the retention pin, so that pairs of adjacent contacts face each other and are simultaneously longitudinally locked by a single retention pin.

Still other objects and features of the present invention will become readily apparent to those skilled in this art from the following description wherein there is shown and described a preferred embodiment of the invention, simply by way of illustration of one of the best modes (an alternative embodiments) suited to carry out the invention. As will be realized, the invention is capable of still other, different, embodiments and its several details are capable of modifications in various obvious aspects, all without departing from the invention. Accordingly, the drawings and the descriptions will be regarded as illustrative in nature, and not as restrictive.

BRIEF DESCRIPTION OF DRAWINGS

The accompanying drawings, incorporated in and forming a part of the specification, illustrate several aspects of the present invention and, together with a description thereof, serve to explain the principles of the invention. In the Drawings.

BEST MODE FOR CARRYING OUT THE INVENTION

Figure 1:
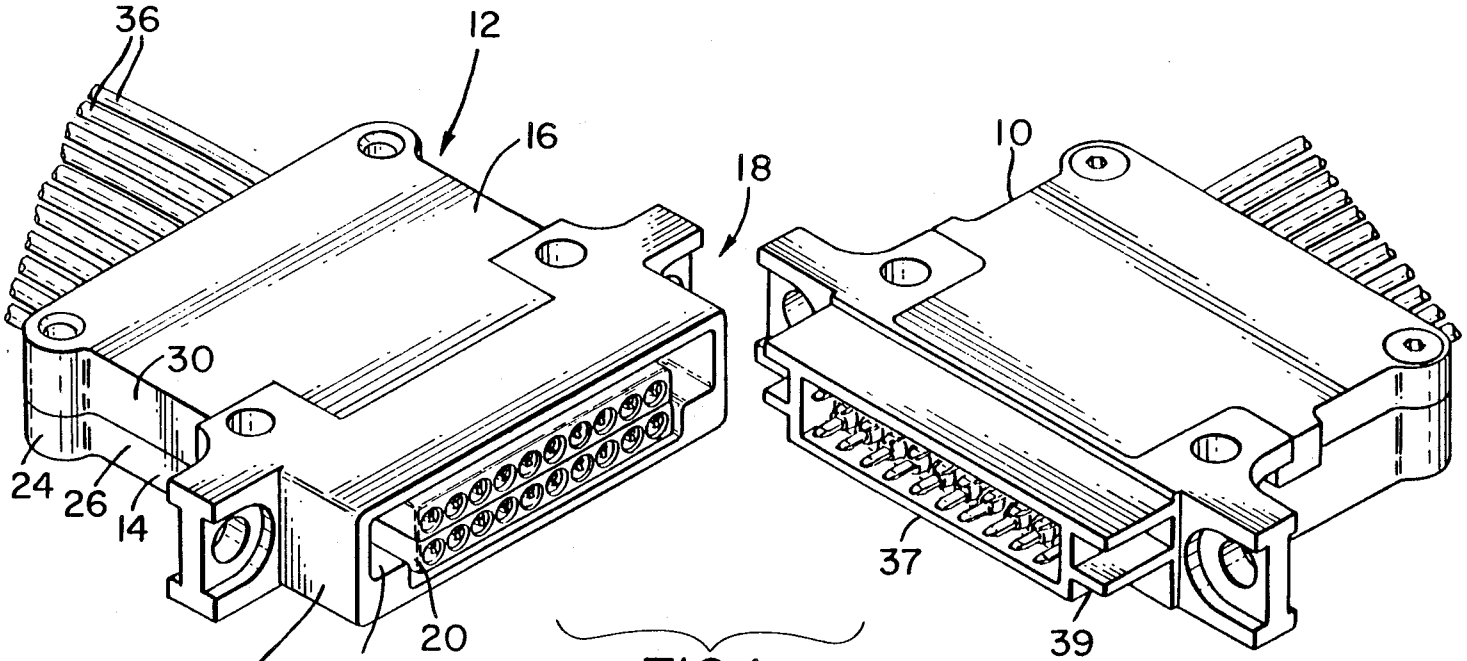
FIG. 1 shows an in-line connector arrangement used as a simple illustration of a number of features of the present invention.

Referring now to FIG. 1, there is shown a perspective view of two halves of an in-line connector arrangement provided as a simplified illustration of various features of the present invention. This connector is fully described in copending application Ser. No. 729,103, filed Apr. 30, 1985, entitled "Modular Connector With Two-Part Housing", filed concurrently herewith, incorporated herein by reference. A male connector, generally designated at 10, is shown along with a female connector, generally designated at 12. With the exception of the type of contact used for the wiring arrangement and the projection of the module at the forward end of the connector, the following description, which is directed towards the female connector 12, is applicable essentially identically to the structure of the male connector 10.

As is noted in the figure, a connector incorporating the features of the present invention includes a receiving portion 14 and a cover portion 16 which, together, generally form a housing 18 for a module 20, a forward end of which is seen in FIG. 1. The receiving portion is seen to have a front portion 22 and a rear portion 24, generally connected by upstanding sidewalls 26. Preferably, the housing is die cast aluminum, although stainless steel or plastic materials may be used.

Figure 2:
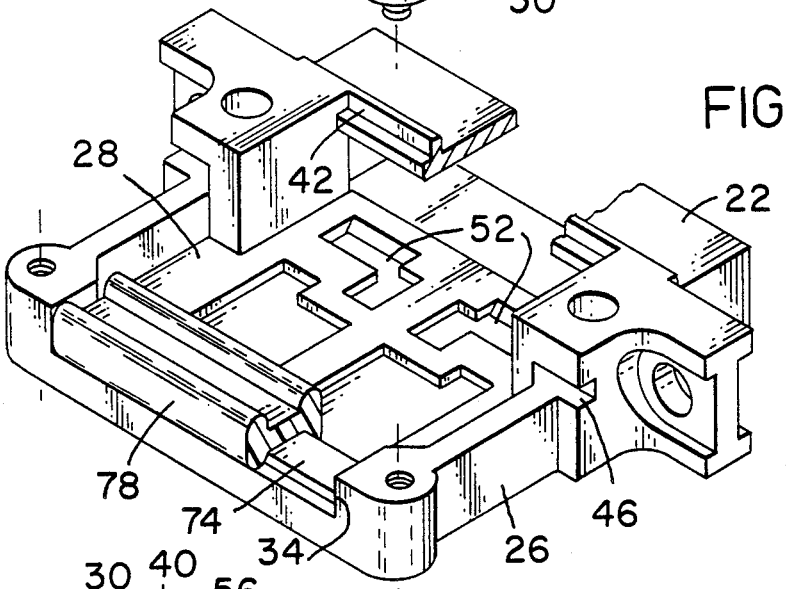
FIG. 2 shows a receiving portion of a housing in the in-line connector of FIG. 1.

As seen in FIG. 2, the receiving portion includes a floor portion 28 connecting the rear portion 24, upstanding sidewalls 26 and the front portion 22.

Figure 3:
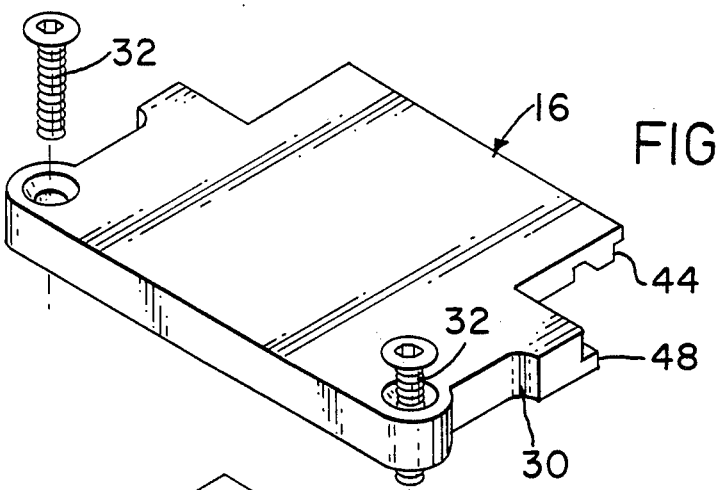
FIG. 3 shows a cover for the receiving portion of FIG. 2.
Figure 4:
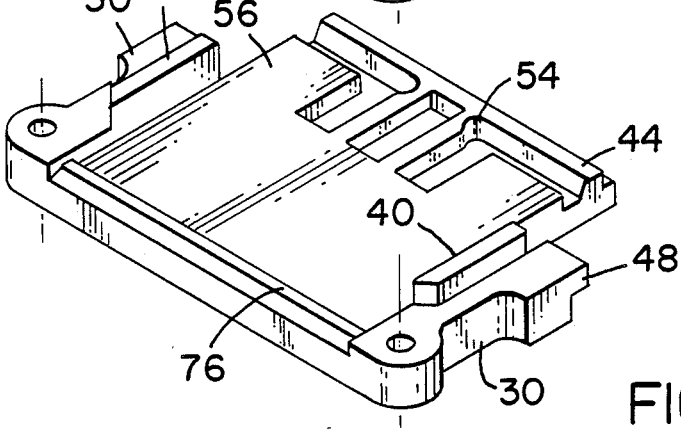
FIG. 4 shows the internal surface of the cover of FIG. 3.

The cover portion 16 is shown at FIG. 3, and the internal details thereof are shown in FIG. 4, illustrating the cover in an inverted position. As is apparent from FIGS. 3 and 4, cover 16 includes depending sidewalls 30 designed for mating with the upstanding sidewalls 26 of the receiving portion 14 of the housing. Thus, when cover 16 is mounted on receiving portion 14 and is fastened thereto by fasteners illustrated as screws 32, a substantially closed housing structure results with a rear opening 34 for receiving wiring arrangement 36 (shown in FIG. 1) therein and with a front opening 38 permitting access to the contacts provided at the forward end of module 20. The housing structure, including the cooperating sidewalls 26 and 30, is seen to provide shielding for the exposed wire terminals and contacts housed therein.

As seen in FIG. 1, the forwardly projecting contacts of male connector 10 are surrounded by an enclosure 37 including outwardly projecting horizontal fins 39. Enclosure 37 is dimensioned to fit within the opening 38. Fins 39 are similarly dimensioned to fit within opening 38. The fins thus provide proper lateral alignment of the enclosure 37 within opening 38, thereby assuring a desired mating contact between corresponding male and female connectors.

In order to lock the cover in the receiving portion and to prevent relative lateral and longitudinal movement therebetween, there are provided flanges 40, shown in FIG. 4, descending from the sidewalls 30 of the cover.

Flanges 40 are inwardly laterally spaced on sidewalls 30 in order to engage inner surfaces of upstanding walls 26 of the receiving portion of the housing. Thus, lateral movement of the cover with respect to the receiving portion is prevented by abutment of flanges 40 against the inner surfaces of upstanding walls 26.

Additionally, in order to prevent forward movement of the cover relative to the receiving portion of the housing, there is provided a rear vertical wall 42 of the front portion 22, as shown in FIG. 2. Similarly, a front wall 44 is provided in the structure of cover 16, as shown at FIGS. 3 and 4, for engaging rear vertical wall 42 when the cover is mounted atop the receiving portion.

Still a further alignment structure provided between the cover and receiving portion is shown at FIGS. 2 and 3 as including a groove 46 in the housing and a matching tongue 48 in cover 16. The tongue and groove arrangement is provided for vertically locking the cover to the receiving portion.

Accordingly, it is seen that the cover includes a self-aligning structure for simplified alignment and assembly with the receiving portion to form the housing of the connector.

Figures 5, 6:
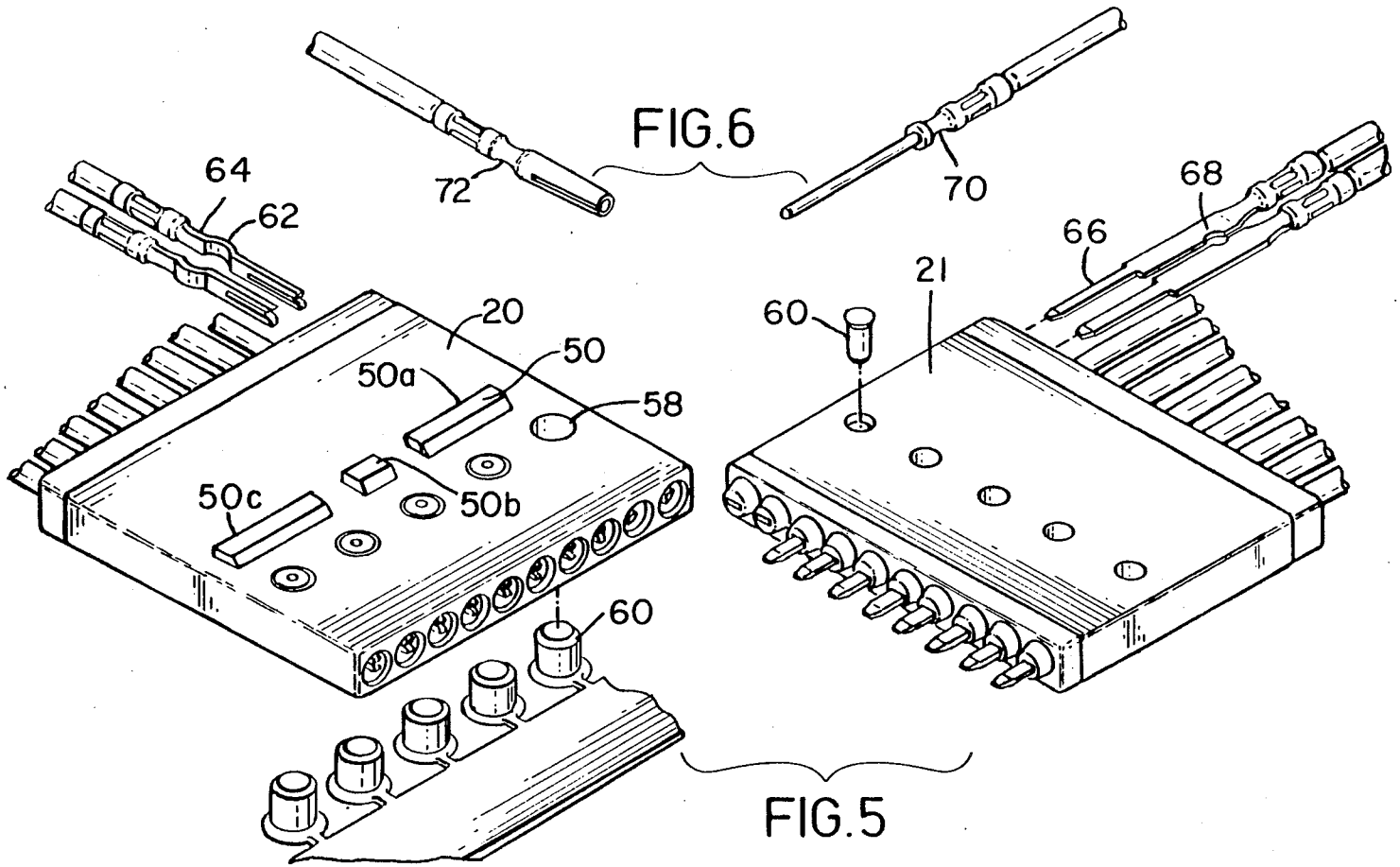
FIG. 5 shows a module and wiring arrangement for the in-line connector of FIG. 1.
FIG. 6 shows an alternative contact set which may be used with the retention arrangement of the structure of FIG. 5.

Reference is now made to FIG. 5, illustrating the two modules used in the two halves of the connector shown in FIG. 1, as well as the contact structure affixed to the wiring arrangement provided therein. With the exception of the male and female contacts and the connection thereof to the front portions of the two modules, it is seen that the modules are substantially identical.

Preferably, the modules are made of a plastic material, capable of withstanding high temperatures, such as polyethylene ether ketone, sold commercially as PEEK. Alternatively, material available commercially as RYTON 7 may be used, although other materials may also be used.

Referring to the module 20 shown in detail at FIG. 5, it is seen that a segmented rib structure 50 is provided on one surface thereof, in which rib segments **50*a*, 50*b*, and 50*c* are arranged laterally on an upper surface of the module and are laterally spaced apart from one another. Although not shown in the drawing, a similar ribbed structure may be provided on the opposite surface of the module. In order to avoid confusion as to the orientation of the module, the segmented rib structure 50 at the one surface of the module preferably differs from any rib structure at the opposite surface thereof. In operation, the connector according to the invention is thus assembled by placing module 20 within receiving portion 14 of the connector. As seen in FIG. 2, a number of channels are provided of floor portion 28 of the receiving portion. Specifically, lateral channel segments 52 are provided for a generally L-shaped channel structure shown therein. The channel arrangement on floor portion 28 corresponds to the rib structure (not shown) on the bottom portion of module 20, so that all sides of the rib segments are engaged by the vertical and slanted surfaces of the channel segments 52. Accordingly, once being so engaged, the module 20 is locked both longitudinally and laterally by the channel structure and is fixed laterally and longitudinally relative to the receiving portion 14** of the housing.

The resulting assembly forms the female connector 12 of FIG. 1. A similar module 21, shown in FIG. 5, may be used for assembling the male connector 10 of FIG. 1. Although not shown in FIG. 5, the male module 21 is provided with a segmented rib structure for lockably engaging the interior of the male connector housing.

Although the ribs are shown at FIG. 5 as being on the top surface of the module, ribs may be provided on the sidewalls of the module. In such an arrangement, various of the sidewall portions of the receiving portion may be provided with channels for locking with any such ribs on the side portions of the module.

As is further shown in FIG. 4, a number of channel segments 54 are provided on an inner bottom surface 56 of the cover.

Channel segments 54, cooperating with the rib structure 50 on the upper surface of the module, provide yet a further structure for locking the module both longitudinally and laterally within the housing. As will be appreciated, when the module is seated within the receiving portion of the housing and the bottom ribs thereof are retained by channel segments 52, cover 16 may be assembled to form the connector by forwardly moving the cover in contact with the module until the segmented rib 50 mates with the engages channel segments 54. Of course, the rib structure and channel segments are arranged on the module and cover, respectively, so that engagement occurs at a point in which the tongue and groove arrangement 48-46 provides vertical interlocking for the cover and receiving portion of the housing. Thus, once the cover is properly seated on the module, the connector is substantially fully assembled, and any further lateral, longitudinal or transverse movement of the module is prevented inasmuch as the module is locked in position both by the receiving portion and the cover of the housing and, further, since the cover is vertically locked by the tongue and groove arrangement thereof.

Referring now to FIGS. 5 and 6, there is shown an arrangement of the present invention for longitudinally locking the contacts within the in-line module and thus within the in-line connector.

Specifically, it is noted that transverse holes 58 are provided in the module. Retention pins 60 are provided for insertion in the holes 58. The retention pins engage a shaped portion 62 of a contact 64 as shown in FIG. 5.

More specifically, for a tuning fork type of receptacle contact there is provided a curved portion matching the curvature of the retention pins 60. The shaped portion 62 is located so that, upon engagement by a pin 60, the forward end of a contact 64 will be at the proper longitudinal position within the longitudinal passageway provided therefor in module 20 to receive the forward end of male contact 66. Thus, once the contact is properly positioned within the passageway, pin 60 is inserted in the hole 58 thereby to lock the contact from further longitudinal movement.

Advantageously, the number of retention pins may be less than the number of contacts and wires retained in the module. As seen in FIG. 5, the adjacent contacts preferably each include a shaped portion matching the shape of one half of a retention pin. Thus, two contacts together are engaged by the retention pin. Since the pin is prevented from longitudinal and lateral movement by the dimensions of hole 58, clearly contacts 64 are similarly prevented from such movement.

Referring to the male contact, shown at 66, a similar arrangement is provided by providing a stamped semi-circular hole at 68, thus providing an appropriately shaped portion for engagement of a retention pin. Again, by arranging the contacts to face each other, each contact having a semi-circular rather than a fully circular shaped portion, there is required but one retention pin for each pair of contacts retained by the module.

While the foregoing discussion relates to a tuning fork type of contact, the present concept is applicable to a pin-and-socket arrangement as well. Referring to FIG. 6, there is shown an illustration of a pin-and-socket contact arrangement which, by providing an appropriate chamfer at 70 and 72, similarly permits use of the retention pin arrangement hereinabove described with reference to FIG. 5. An advantage of the structure of FIG. 6 is that the pin and socket contacts need not be specifically positioned, and pairs of adjacent contacts will engage the retention pins no matter how rotationally oriented when inserted into the module. Upstanding wall 74 and descending wall 76 are associated with the corresponding rear portions of the receiving portion 14 and the cover portion 16, respectively. A pad 78 is provided. Passage of the wiring arrangement 36 between the pad 78 and the wall 76, or between the pad 78 and the wall 74, provides an appropriate tortuous path for the wiring arrangement, thus crimping the same to provide the desired form of strain relief.

Thus, the above described in-line structure permits a simplified locking of a contaact within a module, together with simplified structure for locking a module within a housing and for assembling the entire connector.

Figure 7:
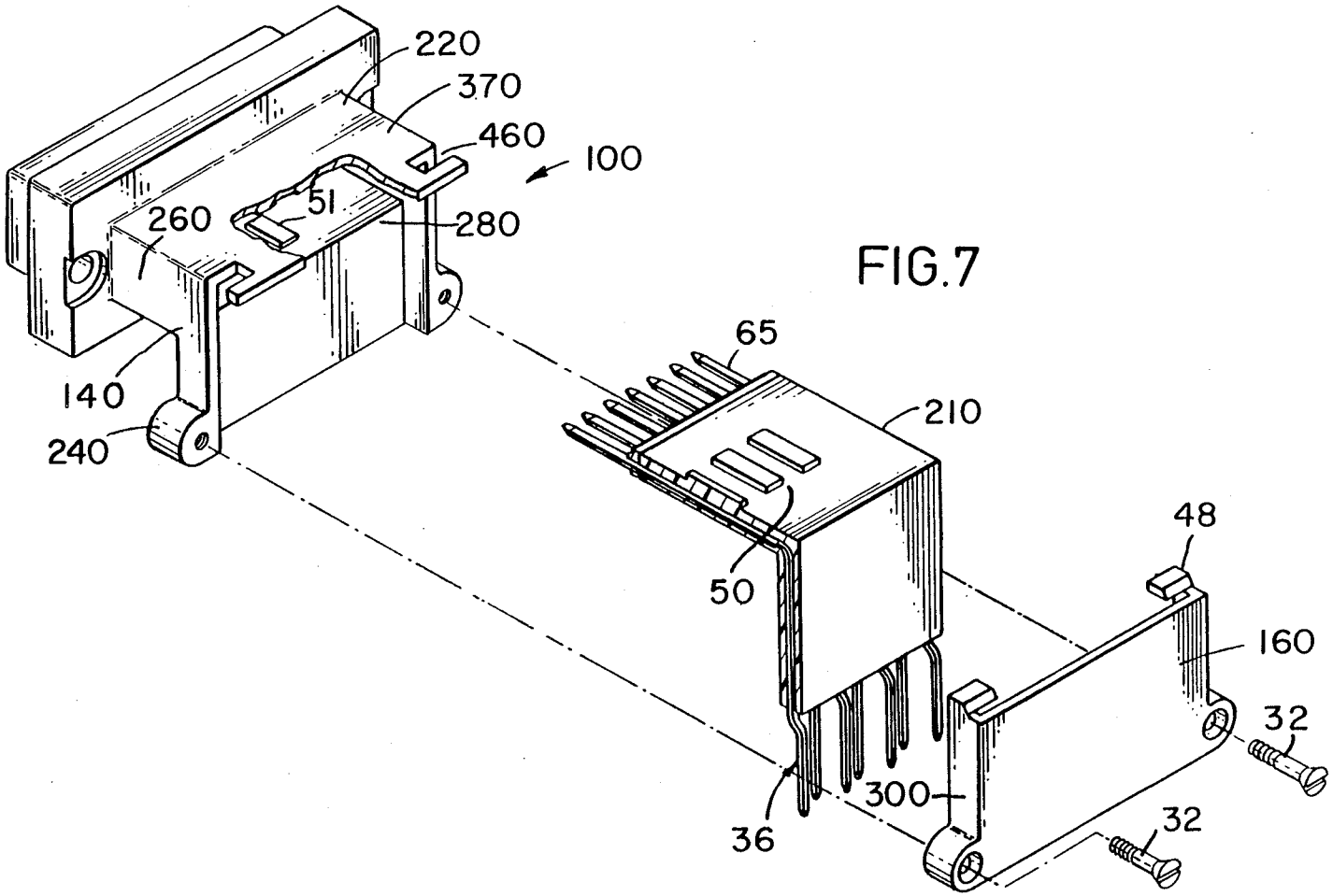
FIG. 7 shows a right-angle connector in accordance with the invention incorporating the principles illustrated in FIGS. 1–6.

Referring now to FIG. 7, there is shown a right-angle connector in accordance with the present invention. The connector of FIG. 7 embodies the various features hereinabove described for the simplified in-line connector.

Specifically, a right-angle male connector 100 is generally shown as including an L-shaped receiving portion 140 and a cover portion 160 therefor. The right-angle connector houses an L-shaped module 210, illustratively shown as a male module. The receiving portion includes a front portion 220 and a rear portion 240, connected by upstanding sidewalls 260 therebetween. The sidewalls, similarly to the receiving means itself, are seen to be L-shaped.

An L-shaped floor portion 280 connects the sidewalls 260, the front portion 220 and the rear portion 240. Similarly to the in-line connector hereinabove described in detail, cover portion 160 provides depending sidewalls 300 for mounting on at least a portion of the upstanding sidewalls 260 of the receiving portion.

Although the cover portion 160 is shown substantially as a planar structure, the cover may, similarly to the module 210, be L-shaped.

As shown in FIG. 7, the module includes a segmented rib structure 50 in which a number of laterally spaced rib segments are provided on at least one surface. Although the rib segments are shown on the upper portion of the L-shaped module, it should be understood that similar segments may be provided on the vertical portion, as well as on side portions thereof. Moreover, the rib segments may similarly be provided on the hidden horizontal and vertical surfaces of the module.

Similarly to the in-line structure, the floor portion 280, the inner surface of cover portion 160, as well as other inner surfaces of the housing include channels for appropriately interlocking with the rib segments. Alternatively, as shown in FIG. 7, the preferred embodiment includes a rib structure 51 on the floor portion 280, and a channel structure (not shown) is provided on the bottom surface of module 210 for interlocking with the rib structure 51.

In view of the L-shaped structure of the connector shown in FIG. 7, the various rib and channel interlocking sections are generally shown as including longitudinal portions only, for preventing lateral movement between the module and the housing. The L-shaped arrangement secures the module longitudinally against the inner surfaces of the housing by providing an abutment between the inner vertical surface (not shown) of module 210, and the vertical surface of the floor portion 280. Of course, the lateral rib and channel portions may be provided in the right-angle connector embodiment shown in the figure.

Again, additional ribs may be provided on the vertical surface of the module 210, with an appropriate channel structure on the inner surface of the cover portion 160. Alternatively, the ribs may be provided on the inner surface of the cover and a channel structure provided on the vertical surface of the module.

Similarly to the male connector portion 10 shown in FIG. 1, the invention structure includes an enclosure 370 at the forward end thereof, for insertion in an opening of the female connector. Additionally, as shown at 460 and 480 in FIG. 7, the inventive structure provides the groove and tongue arrangement previously described in relationship to the in-line assembly of FIGS. 2 and 3. Thus, a groove 460 is provided in the L-shaped receiving portion and a tongue 480 is provided in the cover portion for mating with groove 460 thereby to lock the upper portion of cover 160 relatively to the receiving portion. Fasteners shown in the form of screws 32 are used to fasten the cover to the receiving portion.

Accordingly, in order to assemble the connector shown in FIG. 7, the module 210 is slid into enclosure 370 of receiving portion 140. Any ribs 50 and 51 provided on the module and/or the receiving portion engage corresponding channels provided on the inner surface of the receiving portion or on the module, respectively, thus assuring proper lateral arrangement of the module within the housing. Cover portion 160 is thereafter fastened to the receiving portion by the tongue and groove arrangement and by fasteners 32, and any rib and channel structure which may be provided in the cover and module locks the cover laterally with respect to the module. Fastening screws 32 are used to finalize the assembly of the inventive right-angle connector.

Although not illustrated in the preferred embodiment of FIG. 7, the arrangement used in the embodiment of FIG. 5, including retaining pins and transverse holes in the module, may be used to lock the contacts 65 from the longitudinal movement within the connector of FIG. 7. However, advantageously, the L-shaped structure provides its own longitudinal locking for the contacts 65. Thus, the preferred embodiment does not utilize the retaining pin structure.

There has thus been described in the foregoing specification a modular right-angle connector which includes a two-piece L-shaped housing and an L-shaped module, together with structure for locking the module within the housing without requiring any additional springs or other components therefor. The specified structure further locks the cover and receiving portions of the housing, as well as providing a locking arrangement for the longitudinal positioning of the wires and contacts within the module.

The foregoing description of the preferred embodiment of the invention has been presented for purposes of illustration and description. It is not intended to be exhaustive, or to limit the invention to the precise form disclosed. Obvious modifications or variations are possible in light of the above teaching. The preferred embodiment was chosen and described to provide the best illustration of the principles of the invention and its practical application, thereby to enable one of ordinary skill in the art to utilize the invention in various embodiments and with various modifications as are suited to the particular use contemplated. It is thus intended that the scope of the invention be defined by the claims appended hereto.

What is claimed is:

1. A right angle connector comprising:

housing means formed of a receiving means having a substantially L-shaped longitudinal cross section, upstanding side walls, a rear portion providing a rear opening for a wiring arrangement, a front portion providing a front opening for connection to said wiring arrangement and a floor portion to which said front portion, said side walls and said rear portion are connected, said floor portion including a pair of substantially perpendicular intersecting surfaces within said housing means, insulator module means having a plurality of substantially L-shaped passageways for laterally aligning wiring of said wiring arrangement, cover means mountable on at least one of said side walls for substantially closing said housing means and enclosing said module means therein, said cover means including a substantially flat inner surface facing the interior of the housing means, and locking means for locking said module means longitudinally and laterally within said housing means, said locking means comprising a ribbed structure projecting from said module means and a plurality of channels on at least one internal surface of said housing means for engaging said ribbed structure.

2. A connector as recited in claim 1 wherein said ribbed structure includes a segmented rib having a plurality of rib segments of predetermined length and height and wherein said plurality of channels are provided as a plurality of channel segments having length and depth dimensions opposing and mating with said rib segments for interlocking with said rib segments and for preventing movement of said module means within said housing means.

3. A connector as recited in claim 2 wherein said segmented rib is arranged laterally with respect to said module means.

4. A connector as recited in claim 3 wherein said plurality of rib segments are located on an upper surface of said module means.

5. A connector as recited in claim 1 wherein said cover means includes self aligning means for alignment in engagement with said receiving means, said self aligning means comprising side walls depending from said inner surface thereof for engaging said upstanding side walls of said receiving means and flange means descending from said depending side walls and laterally positioned to engage inner surfaces of said upstanding side walls thereby to lock said cover means laterally with respect to said receiving means.

6. A connector as recited in claim 1 wherein said cover means includes self aligning means for alignment in engagement with said receiving means, said self aligning means comprising tongue and groove means adjacent the intersection of said flat inner surface means of said cover means and said receiving means for preventing transverse movement of said cover means with respect to said receiving means after engagement therewith.

* * * * *